United States Patent [19]

Schaefer et al.

[11] Patent Number: 4,921,895

[45] Date of Patent: May 1, 1990

[54] PREPARATION FOR FINISHING TEXTILE FIBERS AND PRODUCTS AND TEXTILE PRODUCTS HAVING IMPROVED HANDLE

[75] Inventors: Dietmar Schaefer, Essen; Friedhelm Nickel, Bremen, both of Fed. Rep. of Germany

[73] Assignee: Th. Goldschmidt AG

[21] Appl. No.: 298,123

[22] Filed: Jan. 17, 1989

[30] Foreign Application Priority Data

Jan. 29, 1988 [DE] Fed. Rep. of Germany ..... 3802622

[51] Int. Cl.[5] ..... C08K 5/05

[52] U.S. Cl. ..... 524/379; 524/385; 524/588; 524/765; 524/767; 524/837; 524/838; 524/860; 524/869; 525/477

[58] Field of Search ..... 525/477; 524/379, 385, 524/588, 765, 767, 837, 838, 860, 869

[56] References Cited

U.S. PATENT DOCUMENTS

| | | | |
|---|---|---|---|
| 3,389,160 | 6/1968 | Reid | 260/448.2 |
| 4,323,488 | 4/1982 | Takago et al. | 524/863 |
| 4,698,406 | 10/1987 | Lo et al. | 525/477 |

FOREIGN PATENT DOCUMENTS

| | | |
|---|---|---|
| 0125779 | 11/1984 | European Pat. Off. . |
| 3705121 | 2/1987 | Fed. Rep. of Germany . |

OTHER PUBLICATIONS

"Textilveredlung" 20 (1985), pp. 8–12.

*Primary Examiner*—Melvyn I. Marquis

*Attorney, Agent, or Firm*—Toren, McGeady & Associates

[57] ABSTRACT

A preparation for finishing textile fibers or products comprising textile fibers is disclosed. The preparation is liquid and contains 0.5 to 80% by weight of a mixture of modified organopolysiloxane A and B in a ratio of A:B by weight of 10:1 to 1:1, with the proviso that organpolysiloxane A is a linear siloxane containing polyether groups and having at least 40 dialkylsiloxy units, to which are linked at least 2 polyether groups, each of which has a molecular weight of 600 to 4,000 and which comprises 40 to 100 mole percent of oxyethylene units, the remainder being oxypropylene units, the ratio of the number of dialkylsiloxy units to the number of polyether groups being greater than or equal to 8. The organopolysiloxane B is a linear siloxane containing quaternary ammonium groups with at least 20 dialkylsiloxy units, to which at least 2 quaternary ammonium groups are linked over carbon atoms, the ratio of the number of dialkylsiloxy units to the number of quaternary ammonium groups being greater than or equal to 10. The remainder of the preparation comprises water or a water miscible solvent.

The preparation improves the handle of the finished fibers or fiber products while, at the same time, hydrophilizing them. This improvement in handle is also achieved with firmly twisted, open-end yarns. The finished fibers or fiber products can be redyed or overdyed without difficulty. They have good antielectrostatic properties.

12 Claims, No Drawings

PREPARATION FOR FINISHING TEXTILE FIBERS AND PRODUCTS AND TEXTILE PRODUCTS HAVING IMPROVED HANDLE

FIELD OF INVENTION

The invention is generally directed to textile finishing and is particularly concerned with preparations or agents suitable for imparting desirable properties to textile fibers or products made of textile fibers such as woven, knitted or non-woven fabrics.

The textile finishing preparation of the invention is of the kind wherein an aqueous preparation of organosilicon compounds is applied to the fibers to endow them with a hydrophilizing and softening finish.

Considered from another aspect, the invention is directed to finished textile fibers or textile fiber fabrics having superior handle while, at the same time, exhibiting desirable hydrophilicity.

BACKGROUND INFORMATION AND PRIOR ART

Organosilicon compounds are used to an appreciable extent for finishing and improving textile yarns and textiles. The organosilicon compounds act for this purpose in accordance with their respective structure and modification as softeners, antifoaming agents, hydrophobizing agents, sizing agents and as agents to improve the handle.

Due to the possibility to modify organosiloxanes with functional organic groups, the silicones can be adapted to the desired application purpose.

There is an extensive patent literature, which deals with the possibilities of using dimethylpolysiloxanes and polysiloxanes modified with other organic groups. As representative of the literature, reference is made to a survey paper in the journal "Textilveredlung" 20 (1985), pages 8 to 12.

OBJECTS OF THE INVENTION

It is the primary object of the present invention to find and provide agents or preparations for finishing textile fibers or products comprising textile fibers which are capable of improving the handle of fibers or fiber products, while at the same time hydrophilizing them. The improvement in handle is to be achieved even with firmly twisted, open-end yarns. For this purpose, it is important that the preparations wet the textiles well and penetrate the fiber formation. Wetting and penetration should be assured even when finishing hydrophobic textile materials. Aside from providing the textile materials with a good handle, the preparations should also confer good hydrophilicity, in order to assure that the finished textile fibers or textiles can be redyed or overdyed without any It is a further object that the desired finishing agents are in the form of aqueous preparations with a high bath stability. This means they do not demix even after prolonged storage and during use, especially upon dilution, and that they be compatible with other, conventional finishing auxiliaries.

Another object of the invention is to provide textile fibers and fiber products having an improved handle and a high degree of hydrophilicity.

It is also an object of the present invention to provide a method for imparting fibers and fiber products with a finish of the above indicated properties.

Generally, it is an object of the invention to improve on the art of finishing fibers and fiber products.

SUMMARY OF THE INVENTION

The desired combination of properties is surprisingly achieved with a liquid preparation which comprises 0.5 to 80% by weight of a mixture of modified organopolysiloxanes A and B in a weight ratio of A:B of 10:1 to 1:1, wherein organopilysiloxane A is a linear siloxane containing polyether groups and having at least 40 dialkylsiloxy units, to which are linked at least 2 polyether groups, each of which has a molecular weight of 600 to 4,000 and which comprise 40 to 100 mole percent of oxyethylene units, the remainder being oxypropylene units, the ratio of the number of dialkylsiloxy units to the number of polyether groups being greater than or equal to 8 and wherein the organopolysiloxane B is a linear quaternary ammonium group containing siloxane with at least 20 dialkylsiloxy units, to which at least 2 quaternary ammonium groups are linked through carbon atoms, the ratio of the number of dialkylsiloxy units to the number of quaternary ammonium groups being greater than or equal to 10.

Preferably, the preparation comprises:

0.5 to 80% by weight of the organopolysiloxane mixture A, B and 20 to 99.5% by weight of water and/or a water-miscible organic solvent.

Linear polysiloxanes containing polyether groups have long been known and are also used for textile finishing purposes, to improve the handle and as wetting agent. Organosilicon compounds with quaternary ammonium groups, which can be used to reduce the static charge on textiles, are also known from the art.

Unexpectedly and surprisingly, however, it has been ascertained that mixtures of the above-defined organopolysiloxanes A (linear siloxanes containing polyether groups) and organopolysiloxanes B (linear siloxanes containing quaternary ammonium groups) have properties which cannot be found to this extent in the two components A and B taken by themselves. This synergistic effect is unexpected, even taking into consideration the state of the art.

As substantiated in greater detail in the following examples, the synergistic effect of the inventive agent or preparation comprises an appreciable improvement in the handle, which is largely retained even after several delicate laundering cycles. The ability to sew the treated textiles is improved in a particularly surprising manner. This is shown by a considerable reduction in the force required to insert a needle. Stitch damage is considerably reduced during sewing. The mass resistance as a measure of the electrostatic finishing is improved. Textile products, finished with the inventive agent, are free of spots. On treatment in dyeing equipment, there is complete bath exhaustion.

Additional finishing agents in effective amounts may be added to the inventive preparation. Examples of such conventional finishing agents are wrinkle-reducing resins with the necessary acidic catalysts, optical brighteners and fillers.

The modified organopolysiloxanes A and B can be dispersed in water without addition of extraneous emulsifiers. Clear to slightly cloudy colloidal solutions are formed in this manner. These aqueous preparations are stable irrespective of the concentration, that is, they remain stable in the form of stock solutions or in the form of solutions diluted for use; nor do they demix even after prolonged storage.

In a preferred embodiment of the invention, the preparation contains as organopolysiloxane A a polymer of the general, average formula

I

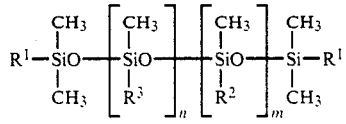

wherein $R^1$ in the molecule are the same or different and represent methyl or the $R^2$ group.

$R^2$ is the $-(CH_2)_3O(C_2H_4O)_x(C_3H_6O)_yR^4$ group, $R^4$=hydrogen, alkyl with 1 to 4 carbon atoms or acyl, x=10 to 50 and y=0 to 40, with the proviso that the average molecular weight of the $R^2$ groups is 600 to 4,000, $R^3$ in the molecule are the same or different and represent an alkyl group with 1 to 20 carbon atoms, with the proviso that at least 90 mole percent of the $R^3$ groups must be methyl, n has a value of 40 to 200, m has a value of 0 to 20, with the proviso that, when m=0, $R^1=R^2$ and, when m>0, the ratio of n:m≧8.

Organopolysiloxanes of this structure are known from the art. They can be synthesized by the addition reaction of the polyoxyalkylene ether of allyl alcohol with the appropriate hydrogensiloxane in the presence of catalysts, particularly platinum catalysts. In the event that up to 10 mole percent of the $R^3$ groups are to be longer-chain alkyl groups, such groups can be introduced by the addition reaction between an appropriate olefin and the SiH groups of the hydrogensiloxane. The synthesis of such compounds is described, for example, in the European Offenlegungsschrift 0 125 779.

As organopolysiloxane B, the inventive agent preferably contains a polymer of the general, average formula

II

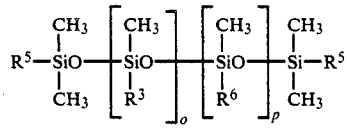

wherein $R^3$ is as defined above, $R^5$ in the molecule are the same or different and represent methyl or the $R^6$ group, $R^6$ represents the

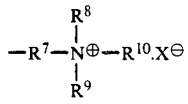

group, $R^7$ is a bivalent hydrocarbon group, the carbon chain of which may be interrupted by an oxygen atom, $R^8$, $R^9$, $R^{10}$ in the molecule and within the group are the same or different and represent alkyl groups with 1 to 18 carbon atoms each, with the proviso that one of the groups, $R^8$, $R^9$, or $R^{10}$ per group may be the $-(CH_2)_3NHCOR^{11}$ group, in which $R^{11}$ is an alkyl group with 7 to 17 atoms, $X^{\ominus}$ is a monovalent anion, o has a value of 20 to 200, p has a value of 0 to 20, with the proviso that, when p=0, $R^5=R^6$, and when p>0, the ratio o:p≧10.

Examples of the $R^7$ group are

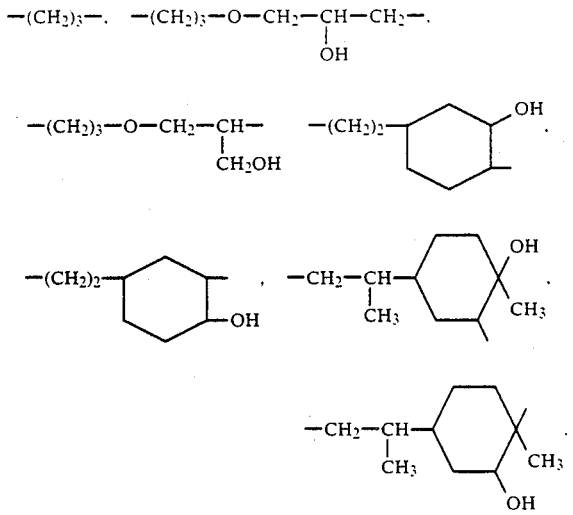

Compounds of this type and their synthesis are described in the German Offenlegungsschrift . . . (Patent Application P 37 19 086.5-44) and the U.S. Pat. 3,389,160. The compounds can be synthesized by reacting an appropriate organopolysiloxane, which has epoxide groups, with tertiary amines in such a quantitative ratio, that at least one tertiary amino group corresponds to each epoxide group. This reaction is carried out in the presence of an acid equivalent, based on the nitrogen atom to be quaternized, at elevated temperatures.

In another preferred embodiment, the inventive agent contains as organopolysiloxane B a polymer of the general, average formula

III

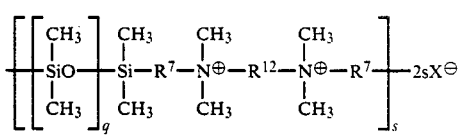

wherein $R^7$, $X^{\ominus}$ are as defined above $R^{12}$ is a bivalent hydrocarbon group with at least 2 carbon atoms, which may comprise a hydroxyl group and the carbon chain of which may be interrupted by an oxygen or a nitrogen atom, q has a value of 20 to 200 and s≧1.

The units of the polymer occur in essentially repeating formations of s>1.

Examples of the substituent $R^{12}$ are $-CH_2-CH_2-CH_2-CH_2-CH_2-CH_2-$, $-CH_2-CH_2-O-CH_2-CH_2-$, -continued $$-CH_2-CH_2-\underset{\underset{CH_3}{|}}{N}-CH_2-CH_2-.$$

Compounds of this type are described in the German Offenlegungsschrift . . . (Patent Application P 37 05 121.0-44). In accordance with the synthesis method described there in greater detail, $\alpha,\omega$-hydrogenpolysiloxane are reacted first with, based on the SiH groups, equimolar amounts of an epoxide, which has a terminal olefinic double bond, in the presence of a hydrosilylating catalyst in a known manner. Subsequently, the reaction product, so obtained, is reacted with a ditertiary amine in the presence of 2 mole equivalents of acid, based on the diamine, at elevated temperatures in such amounts, that an amino group corresponds to each epoxide group.

Examples of siloxanes, which can be used pursuant to the invention, are:

Siloxane A

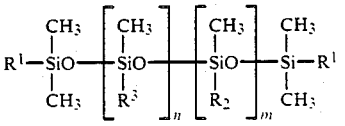

A1 $R^1 = R^3 = CH_3$;
$R^2 = -(CH_2)_3-O-C_2H_4O)_{30}-H$;
$n = 50$, $m = 5$

A2 $R^1 = R^2 = -(CH_2)_3-O-(C_2H_4O)_{20}-(C_3H_6O)_5-H$;
$R^3 = CH_3$;
$n = 150$, $m = 10$

A3 $R^1 = CH_3$;
$R^2 = -(CH_2)_3-O-(C_2H_4O)_{35}-H$;
$R^3 = 5$ Mol-% $C_{16}H_{33}$ und 95 Mol-% $CH_3$;
$n = 125$, $m = 15$ A4 $R^1 = R^2 = -(CH_2)_3-O-(C_2H_4O)_{20}-(C_3H_6O)_2-CH_3$;
$R^3 = CH_3$;
$n = 55$ $m = 0$ A5 $R^1 = R^3 = CH_3$;
$R^2 = -(CH_2)_3-O-(C_2H_4O)_{40}-\overset{\overset{O}{\|}}{C}-CH_3$;
$n = 200$, $m = 10$ Siloxane B

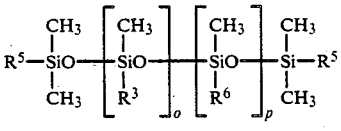

Formula B*

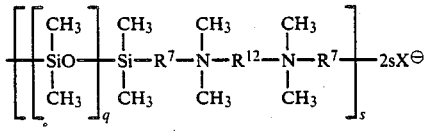

Formula B**

Formula B*

B1 $R^5 = R^3 = CH_3$;

$R^6 = -(CH_2)_3-O-CH_2-\overset{\overset{OH}{|}}{CH}-CH_2-N^{\oplus}(CH_3)_3Cl^{\ominus}$ Formula B*

B2 $R^5 = R^6 =$ 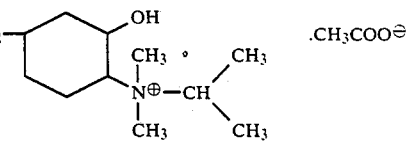 $.CH_3COO^{\ominus}$ $R^3 = CH_3$;
$o = 150$, $p = 10$ -continued Formula B*

B3 $R^5 = R^6 =$ $$-(CH_2)_3-O-CH_2-\underset{}{\overset{OH}{\overset{|}{CH}}}-CH_2-\overset{CH_3}{\overset{|}{\underset{CH_3}{\underset{|}{N^{\oplus}}}}}-(CH_2)_3NH\overset{O}{\overset{\|}{C}}-C_{12}H_{25}.CH_3COO^{\ominus}$$

$R^3 = CH_3$;
$o = 30, p = 0$

Formula B**

B4 $R^7 = -(CH_2)_3-O-CH_2-\overset{OH}{\overset{|}{CH}}-CH_2-$;
$R^{12} = -(CH_2)_4-$;
$X^{\ominus} = CH_3COO^{\ominus}$;
$q = 30, s > 1$ Formula B**

B5 $R^7 =$ 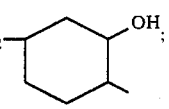 ;

$R^{12} = -(CH_2)_2-O-(CH_2)_2-$;
$X^{\ominus} = Cl^{\ominus}$;
$q = 100, s > 1$ Formula B*

B6 $R^5 = R^3 = CH_3$;

$$R^6 = -(CH_2)_3-O-CH_2-\overset{OH}{\overset{|}{CH}}-CH_2-\overset{CH_3}{\overset{|}{\underset{CH_3}{\underset{|}{N^{\oplus}}}}}-C_{18}H_{37}.Br^{\ominus}$$

$o = 20, p = 2$

Formula B*

B7 $R^5 = R^6 = -(CH_2)_3-N^{\oplus}(CH_3)_3Cl^{\ominus}$
$R^3 = CH_3$;
$o = 20, p = 0$ Examples of the inventive agent (data in % by weight):

| | | |
|---|---|---|
| 1. | 20% | siloxane A 1 |
| | 5% | siloxane B 3 |
| | 30% | 1,2-propylene glycol |
| | 45% | water |
| 2. | 10% | siloxane A 1 |
| | 10% | siloxane A 4 |
| | 10% | siloxane B 1 |
| | 70% | water |
| 3. | 60% | siloxane A 4 |
| | 6% | siloxane B 2 |
| | 34% | 1,2-propylene glycol |
| 4. | 5% | siloxane A 2 |
| | 5% | siloxane B 5 |
| | 90% | water |
| 5. | 20% | siloxane A 5 |
| | 10% | siloxane B 4 |
| | 5% | siloxane B 6 |
| | 30% | isopropanol |
| | 35% | water |
| 6. | 2% | siloxane A 3 |
| | 2% | siloxane B 6 |
| | 96% | water |
| 7. | 10% | siloxane A 4 |
| | 5% | siloxane B 7 |
| | 85% | water |

In the following examples, the properties of agents which contain only organopolysiloxane A are compared with those of inventive agents or preparations which contain organopolysiloxanes A and B together, and the synergistic effect is demonstrated. The aqueous preparations are obtained by the simple incorporation of water under conditions of high shear into the modified organopolysiloxanes A or A and B.

EXAMPLE 1

(not of the invention)

Preparation 1 comprises a 30% by weight aqueous solution of organopolysiloxane A, in which the groups and subscripts in general Formula I have the following meaning:

$n=20$,
$m=5$,
$R^1=-CH_3$,
$R^2=-(CH_2)_3-O-(C_2H_4O)_x-(C_3H_6O)_y-H$,
$x=11$,
$y=3$,
$R^3=-CH_3$.

EXAMPLE 2

(not of the invention)

Preparation 2 comprises a 30% by weight aqueous solution of organopolysiloxane A, in which the groups and subscripts in general Formula I have the following meaning:

$n=75$,
$m=5$,
$R^1=-CH_3$
$R^2=-(CH_2)_3-O-(C_2H_4O)_x-(C_3H_6O)_y-H$,
$x=20$,
$y=5$,
$R^3=-CH_3$

EXAMPLE 3

(of the invention)

Preparation 3 comprises a 30% by weight aqueous solution of a mixture of organopolysiloxanes A and B in the ratio by weight of 4:1, in which the groups and subscripts in general Formula I of polymer A have the following meaning:

$n=75$,
$m=5$,
$R^1=-CH_3$,
$R^2=-(CH_2)_3-O-(C_2H_4O)_x-(C_3H_6O)_y-H$,
$x=20$,
$y=5$,
$R^3=-CH_3$, and the groups and subscripts in the general Formula II of polymer B have the following meaning:

$R^3=-CH_3$,
$o=80$
$p=5$,
$R^5=-CH_3$, $$R^6 = -(CH_2)_3-O-CH_2-\overset{\overset{\displaystyle OH}{|}}{CH}-CH_2-N^{\oplus}(CH_3)_3.Cl^{\ominus}$$

EXAMPLE 4

(of the invention)

Preparation 4 comprises a 30% by weight aqueous solution of a mixture of organopolysiloxanes A and B in the ratio by weight of 6:1, in which the groups and subscripts in general Formula I of polymer A have the following meaning:

$n=75$,
$m=5$,
$R^1=-CH_3$,
$R^2=-(CH_2)_3-O-(C_2H_4O)_x-(C_3H_6O)_y-H$,
$x=20$,
$y=5$,
$R^3=-CH_3$, and the groups and subscripts in the general Formula II of polymer B have the following meaning:

$R^3=-CH_3$,
$o=30$,
$p=0$,
$R^5=R^6$, $R^6 =$

-continued $$-(CH_2)_3-O-CH_2-\underset{\underset{\displaystyle OH}{|}}{CH}-CH_2-\overset{\overset{\displaystyle CH_3}{|}}{\underset{\underset{\displaystyle CH_3}{|}}{N^{\oplus}}}-C_{18}H_{37}.H_3C-COO^{\ominus}$$

EXAMPLE 5

(of the invention)

Preparation 5 comprises a 30% by weight aqueous solution of a mixture of organopolysiloxanes A and B in the ratio by weight of 2:1, in which the groups and subscripts in general Formula I of polymer A have the following meaning:

$n=90$,
$m=6$,
$R^1=-CH_3$,
$R^2=-(CH_2)_3-O-(C_2H_4O)_x-(C_3H_6O)_y-H$,
$x=30$,
$y=0$,
$R^3=-CH_3$, and the groups and subscripts in the general Formula III of polymer B have the following meaning:

$$R^7 = -(CH_2)_3-O-CH_2-\underset{\underset{\displaystyle OH}{|}}{CH}-CH_2-.$$

$q=25$,
$s>1$,
$R^{12}=-(CH_2)_6-$,
$X^{\ominus}=H_3C-COO^{\ominus}$

EXAMPLE 6

(not of the invention)

Preparation 6 comprises an aqueous 15% by weight emulsion of a dimethylpolysiloxane with a viscosity of 10,000 $mm^2s^{-1}$ and 15% by weight of an organic softener based on a quaternary imidazoline compound with two longer aliphatic alkyl groups, each with 18 carbon atoms.

TESTING THE APPLICATION OF PREPARATIONS 1 TO 6

A cotton/polyester knitted fabric (36/55) of open-end spun yarns is dyed in a jet dyeing apparatus and then treated for 20 minutes at 45° C. in each case with 2% by weight, based on the fabric weight, of preparations 1 to 6 at a liquor ratio of 1:10 and a pH of 6±0.5.

After drying under conditions normally employed in practice, the article is conditioned and checked by textile testing methods. The results obtained are listed in the following Table.

TABLE

| Property | Preparation | 1 | 2 | 3 | 4 | 5 | 6 | untreated |
|---|---|---|---|---|---|---|---|---|
| Handle | soft | + | ++ | +++ | +++ | ++ | ++ | − |
| | full | +/− | +/− | + | ++ | +++ | + | − |
| | smooth | +/− | + | ++ | ++ | +++ | ++ | − |
| Handle after 3 delicate washing cycles at 40° C. | soft | − | + | +++ | +++ | ++ | + | − |
| | full | − | − | + | + | ++ | +/− | − |
| | smooth | − | +/− | + | + | ++ | +/− | − |
| Hydrophilicity rise height (mm) | | 67 | 62 | 64 | 60 | 71 | 46 | 58 |
| Ability to sew the textiles - force required to insert needle - (g) | | 72 | 58 | 34 | 32 | 27 | 43 | 138 |
| Stitch damage | | 3 | 2 | 1 | — | — | 2 | 8 |

TABLE-continued

| Property | Preparation | 1 | 2 | 3 | 4 | 5 | 6 | untreated |
|---|---|---|---|---|---|---|---|---|
| per 100 needle insertions | | | | | | | | |
| Mass Resistance Ω | | $2 \times 10^{10}$ | $2 \times 10^{10}$ | $4 \times 10^{8}$ | $3 \times 10^{9}$ | $2 \times 10^{7}$ | $1.8 \times 10^{9}$ | $4 \times 10^{10}$ |
| Other | | * | * | | | | ** | |

*Incomplete bath exhaustion during treatment in dyeing apparatus
**After the treatment, a few silicone spots can be seen on the fabric
Handle was evaluated by five persons. The following is a key of the symbols:
– initial value
–/– slight improvement in handle
– clear improvement in handle
– – significant improvement in handle
– – – very significant improvement in handle

What is claimed is:

1. A preparation suitable for finishing textile fibers and products, comprising (a) between about 0.5 to 80% by weight of a mixture of first and second modified organopolysiloxanes in a weight ratio of first to second organopolysiloxane of 10:1 to 1:1, wherein the first organopolysiloxane is a linear siloxane with polyether groups and having at least 40 dialkylsiloxy units, to which are linked at least 2 polyether groups, each of which has a molecular weight of about between 600 to 4,000 and comprises 40 to 100 mole percent of oxyethylene units, the remainder being oxypropylene units, the ratio of the number of dialkylsiloxy units to the number of polyether groups being greater than or equal to 8, said second organopolysiloxane being a linear siloxane containing quaternary ammonium groups with at least 20 dialkylsiloxy units, to which at least 2 quaternary ammonium groups are linked through carbon atoms, the ratio of the number of dialkylsiloxy units to the number of quaternary ammonium groups being greater than or equal to 10, and (b) a solvent vehicle selected from the group consisting of water and water miscible solvents.

2. A preparation as claimed in claim 1, wherein said first organopolysiloxane is a polymer of the general average formula

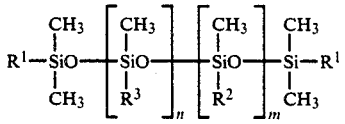

wherein $R^1$ within the molecule is the same or different and represent methyl or the $R^2$ group $-(CH_2)_3O(C_2H_4O)_x(C_3H_6O)_yR^4$ in which $R^4$=hydrogen, alkyl with 1 to 4 carbon atoms or acyl, x=10 to 50 and y=0 to 40, with the proviso that the average molecular weight of the $R^2$ groups is 600 to 4,000, $R^3$ within the molecule is the same or different and represent an alkyl group with 1 to 20 carbon atoms, with the proviso that at least 90 mole percent of the $R^3$ groups are methyl, n has a value of 40 to 200, m has a value of 0 to 20, with the proviso that, when m=0, $R^1=R^2$ and, when m>0, the ratio of n:m≧8.

3. A preparation as claimed in claim 1 or 2, wherein said second organopolysiloxane is a polymer of the general, average formula

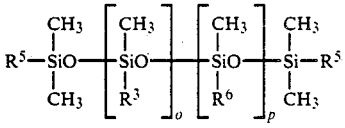

wherein $R^3$ within the molecule is the same or different and represent an alkyl group with 1 to 20 carbon atoms, with the proviso that at least 90 mole percent of the $R^3$ groups are methyl, $R^5$ within the molecule is the same or different and represent methyl or the $R^6$ group

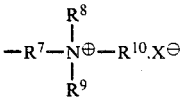

in which $R^7$ is a bivalent hydrocarbon group, or a bivalent hydrocarbon group the carbon chain of which is interrupted by an oxygen atom, $R^8$, $R^9$, $R^{10}$ within the molecule and the group are the same or different and each represents alkyl with 1 to 18 carbon atoms or one of the groups $R^8$, $R^9$, or $R^{10}$ per group is the $-(CH_2)_3NHCOR^{11}$ group, in which $R^{11}$ is an alkyl group with 7 to 17 atoms, the remainder of the $R^8$, $R^9$ and $R^{10}$ groups being alkyl with 18 carbon atoms, $X^{\ominus}$ is any monovalent anion, o has a value of 20 to 200, p has a value of 0 to 20, with the proviswo that, when p=0, $R^5=R^6$, and when p>0, the ratio o:p≧10.

4. The preparation as claimed in claim 1 or 2, wherein said second organopolysiloxane is a polymer of the general, average formula

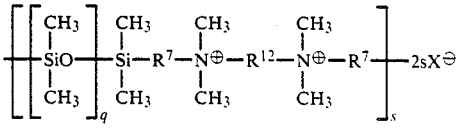

wherein $R^7$ is a bivalent hydrocarbon group, or a bivalent hydrocarbon group the carbon chain of which is interrupted by an oxygen atom, $X^{\ominus}$ is any monovalent anion, $R^{12}$ is a bivalent hydrocarbon group with at least 2 carbon atoms and containing a hydroxyl group or a bivalent hydrocarbon group with at least 2 carbon atoms and containing a hydroxyl group, the carbon chain of which is interrupted by an oxygen or a nitrogen atom, q has a value of 20 to 200, and $s \geqq 1$.

5. The preparation of claim 4, wherein when $s > 1$, the units of the polymer occur in repeating formations.

6. A preparation as claimed in claim 1, consisting essentially of between about 0.5 to 80% by weight of said mixture and between about 20 to 99.5% by weight of said solvent vehicle.

7. A method of finishing textile fibers or textile fiber products which comprises applying to the fibers or fiber products the preparation of claims 1 or 6 and then drying the fibers or fiber products.

8. A method of finishing textile fibers or textile fiber products which comprises applying to the fibers or fiber products the preparation of claims 2 or 3 and then drying the fibers or fiber products.

9. A method of finishing textile fibers or textile fiber products which comprises applying to the fibers or fiber products the preparation of claim 4 and then drying the fibers or fiber products.

10. The fibers or products obtained by the method of claim 7.

11. The fibers or products obtained by the method of claim 8.

12. The fibers or products obtained by the method of claim 9.

* * * * *